US006736123B1

(12) United States Patent
Summers et al.

(10) Patent No.: US 6,736,123 B1
(45) Date of Patent: May 18, 2004

(54) CROSSBOW TRIGGER

(75) Inventors: Randy V. Summers, Madison Heights, VA (US); Marc T. Rentz, Madison Heights, VA (US)

(73) Assignee: Gregory E. Summers, Lynchburg, VA (US)

( * ) Notice: Subject to any disclaimer, the term of this patent is extended or adjusted under 35 U.S.C. 154(b) by 0 days.

(21) Appl. No.: 10/377,774

(22) Filed: Mar. 4, 2003

(51) Int. Cl.[7] ..... F41B 5/00
(52) U.S. Cl. ..... 124/25; 124/40
(58) Field of Search ..... 124/31, 35.1, 25, 124/40

(56) References Cited

U.S. PATENT DOCUMENTS

| | | | | |
|---|---|---|---|---|
| 3,968,783 A | | 7/1976 | Pfotenhauer | |
| 4,030,473 A | | 6/1977 | Puryear | |
| 4,173,964 A | | 11/1979 | Curran | |
| 4,192,281 A | | 3/1980 | King | |
| 4,294,222 A | | 10/1981 | Pelsue | |
| 4,479,480 A | | 10/1984 | Holt | |
| 4,603,676 A | | 8/1986 | Luoma | |
| 4,662,345 A | | 5/1987 | Stephens | |
| 4,693,228 A | | 9/1987 | Simonds et al. | |
| 4,716,880 A | | 1/1988 | Adkins | |
| 4,721,092 A | | 1/1988 | Waiser | |
| 4,722,318 A | | 2/1988 | Yankey | |
| 4,732,134 A | | 3/1988 | Waiser | |
| 4,877,008 A | | 10/1989 | Troubridge | |
| 4,962,747 A | | 10/1990 | Biller | |
| 5,025,771 A | | 6/1991 | Hanson | |
| 5,085,200 A | | 2/1992 | Horton-Corcoran et al. | |
| 5,215,069 A | | 6/1993 | Liu | |
| 5,553,596 A | | 9/1996 | Bednar | |
| 5,596,976 A | | 1/1997 | Waiser | |
| 5,598,829 A | | 2/1997 | Bednar | |
| 5,619,979 A | | 4/1997 | Ossege | |
| 5,642,723 A | * | 7/1997 | Hogan | 124/22 |
| 5,649,520 A | | 7/1997 | Bednar | |
| 5,680,853 A | | 10/1997 | Clayton | |
| 5,884,614 A | | 3/1999 | Darlington et al. | |
| 6,095,128 A | | 8/2000 | Bednar | |
| 6,205,990 B1 | | 3/2001 | Adkins | |
| 6,286,496 B1 | | 9/2001 | Bednar | |
| 6,425,386 B1 | * | 7/2002 | Adkins | 124/31 |
| 6,460,528 B1 | | 10/2002 | Gallops, Jr. | |

FOREIGN PATENT DOCUMENTS

| | | |
|---|---|---|
| CA | 2066679 | 3/1991 |

* cited by examiner

*Primary Examiner*—Jacob K. Ackun
(74) *Attorney, Agent, or Firm*—Nixon & Vanderhye P.C.

(57) ABSTRACT

A crossbow trigger mechanism includes a trigger housing; a jaw component pivotably mounted in the trigger housing and adapted to move between a bowstring retaining position and a bowstring releasing position; and a trigger assembly pivotably mounted in the trigger housing and operatively engaged with the jaw. A safety lever is pivotably mounted in the trigger housing and movable manually into and out of engagement with the trigger assembly. A dry fire prevention lever is pivotably mounted on the jaw component and includes a first surface portion adapted and arranged to engage a stop fixed to the trigger housing when no arrow is loaded in the crossbow and thus prevent movement of the jaw component to the bowstring releasing position, and a second surface portion adapted to be engaged by an arrow such that when an arrow is loaded into the crossbow, the first surface portion is moved away from the stop to thereby permit movement of the jaw component to the bowstring releasing position.

27 Claims, 14 Drawing Sheets

CROSSBOW TRIGGER

This invention relates to crossbow firing or trigger mechanisms and, more specifically, to a crossbow trigger mechanism that incorporates two discrete safety features including dry fire prevention and manual on/off safety lever mechanisms.

BACKGROUND OF THE INVENTION

Crossbow triggers are known that incorporate on/off type safeties that can be manipulated by the user to permit or prevent firing of an arrow. Safeties of this type act directly on the trigger without regard for whether or not an arrow has been loaded into the crossbow. In other words, on/off safeties do not prevent the dry firing of an arrow, i.e., release of a cocked bowstring with no arrow loaded into the crossbow. It is well known, however, that dry firing can cause severe damage to the crossbow itself, and prevention of dry firing is therefore highly desirable. Prior patents that describe dry fire prevention devices and/or additional safety features such as on/off devices include U.S. Pat. Nos. 4,721,092; 5,085,200; 5,596,976; 5,884,614; and 6,205,990.

There remains a need for a simple but highly reliable crossbow trigger mechanism that incorporates both a traditional on/off safety feature as well as an effective dry fire prevention feature that prevents release of the bowstring when there is no arrow in the crossbow.

BRIEF DESCRIPTION OF THE INVENTION

In accordance with a first and preferred exemplary embodiment of this invention, a crossbow trigger mechanism is provided as a self-contained unit, supported within a trigger housing, and adapted for mounting in the stock of a crossbow. The trigger mechanism includes a pivotably mounted jaw component that incorporates a pair of bowstring retaining prongs, and that is movable between bowstring retaining and bowstring releasing positions. The trigger mechanism also includes a trigger lever assembly pivotably mounted within the housing, comprised of a trigger lever joined to a trigger block. The trigger block interacts with a sear element that is operatively interposed between the jaw component and the trigger block.

With a bowstring in the cocked position, and an arrow loaded into the crossbow, pulling and hence rotation of the trigger lever will cause pivoting motion of the sear to a position where the jaw component may pivot past the sear under the forces developed by the tensioned bowstring. In this embodiment, the jaw component incorporates a roller that rolls over an edge of the sear as the sear pivots due to movement of the trigger. The trigger lever assembly, sear and jaw component are all normally biased by spring elements to a non-firing position.

An on/off safety lever projects through the rear of the housing and is pivotably mounted in the housing for interaction with the trigger block. A safety lever actuating link is pivotably mounted on the jaw component and extends rearwardly for interaction with the safety lever during cocking of a bowstring. Specifically, movement of the jaw component to the string retaining position as the bowstring is pulled into the trigger housing, will cause the on/off safety lever, via the safety lever actuating link, to move from an "off" to an "on" position where it engages the trigger block and prevents any rotation of the trigger lever assembly. When the arrow is otherwise ready for firing, the user can simply move the on/off safety lever manually to the "off" position, where the safety lever is disengaged from the trigger block so that the trigger can be rotated by the user to fire the arrow.

A forwardly extending dry fire prevention lever is also pivotably mounted on the jaw component, with an upper leg portion normally protruding into the area supporting an arrow before the latter is loaded into the crossbow. In this normal position, a lower leg portion of the lever is aligned with a fixed stop secured to a wall of the housing. A torsion spring mounted at the pivot location of the lever biases the lever into this normal position, which prevents the jaw component from rotating out of its bowstring retaining position. When an arrow is loaded into the crossbow, however, the dry fire prevention lever is pushed downwardly by the arrow, causing the lower leg portion to move away from the fixed housing stop, thus permitting the jaw component to move from the string retaining position to the string releasing position when the trigger is pulled.

In a second embodiment, the dry fire prevention lever is pivotally secured to the housing and arranged to engage the jaw component itself so as to prevent rotation of the latter when no arrow is loaded into the crossbow. When an arrow is loaded into the crossbow, the dry fire prevention lever pivots downwardly away from the jaw component, thereby permitting the jaw component to move to the arrow releasing position. In this embodiment, the jaw component does not incorporate a roller but, rather, is formed with an integral curved camming surface that interacts with the sear.

Accordingly, in one aspect, the invention relates to a crossbow trigger mechanism comprising a trigger housing; a jaw component pivotably mounted in the trigger housing and adapted to move between a bowstring retaining position and a bowstring releasing position; a trigger assembly pivotably mounted in the trigger housing and operatively engaged with the jaw; a safety lever pivotably mounted in the trigger housing and movable manually into and out of engagement with the trigger assembly; and a dry fire prevention lever pivotably mounted on the jaw component and comprising a first surface portion adapted and arranged to engage a stop fixed to the trigger housing when no arrow is loaded in the crossbow and thus prevent movement of the jaw component to the bowstring releasing position, and a second surface portion adapted to be engaged by an arrow such that when an arrow is loaded into the crossbow, the first surface portion is moved away from the stop to thereby permit movement of the jaw component to the bowstring releasing position.

In another aspect, the invention relates to a crossbow trigger mechanism comprising a trigger housing; a jaw component pivotably mounted in the trigger housing and adapted to move between a bowstring retaining position and a bowstring releasing position; a trigger assembly pivotably mounted in the trigger housing and operatively engaged with the jaw; and a dry fire prevention lever pivotably mounted on the jaw component comprising a first surface portion adapted and arranged to engage a stop fixed to the trigger housing when no arrow is loaded in the crossbow and thereby prevent movement of the jaw component to the bowstring releasing position, and a second surface portion adapted to be engaged by an arrow such that, when an arrow is loaded into the crossbow, the first surface portion moves away from the stop to thereby permit movement of the jaw component to the bowstring releasing position.

In still another aspect, the invention relates to a crossbow trigger mechanism comprising: a trigger housing adapted for mounting on a crossbow; a jaw component pivotably mounted in the trigger housing and adapted to move between a bowstring retaining position and a bowstring releasing position; a trigger assembly pivotably mounted in the trigger housing and operatively engaged with the jaw; a safety lever pivotably mounted in the trigger housing and movable manually into and out of engagement with the trigger assembly; and a safety lever actuating link with one end pivotally mounted on the jaw component, and an opposite end engageable with the safety lever. A dry fire prevention lever may be incorporated into the mechanism that is adapted to engage either a fixed housing stop or the jaw component itself to prevent movement of the jaw component to the bowstring release position when there is no arrow in the crossbow.

The invention will now be described in connection with the drawing figures identified below.

DETAILED DESCRIPTION OF THE INVENTION

Figure 1:
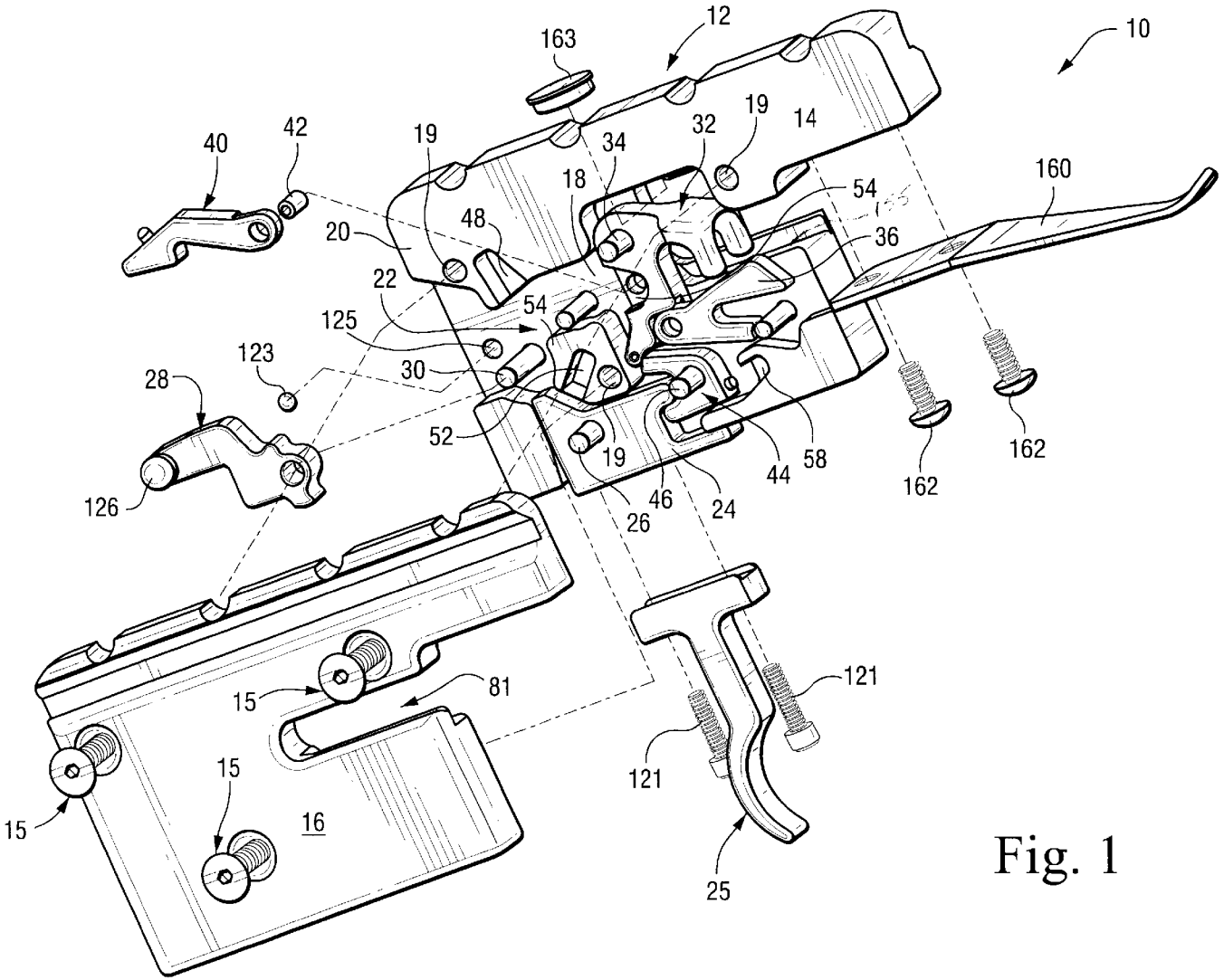
FIG. 1 is an exploded perspective view of the crossbow trigger mechanism in accordance with an exemplary embodiment of the invention.
Figure 3:
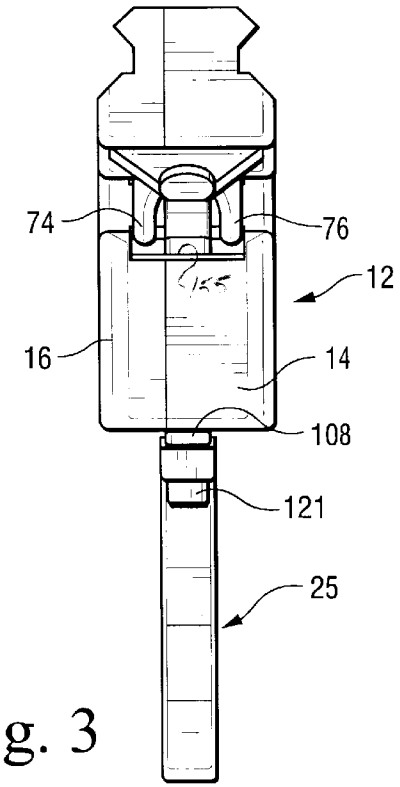
FIG. 3 is a front end elevation of the crossbow trigger mechanism shown in FIG. 2.
Figure 2:
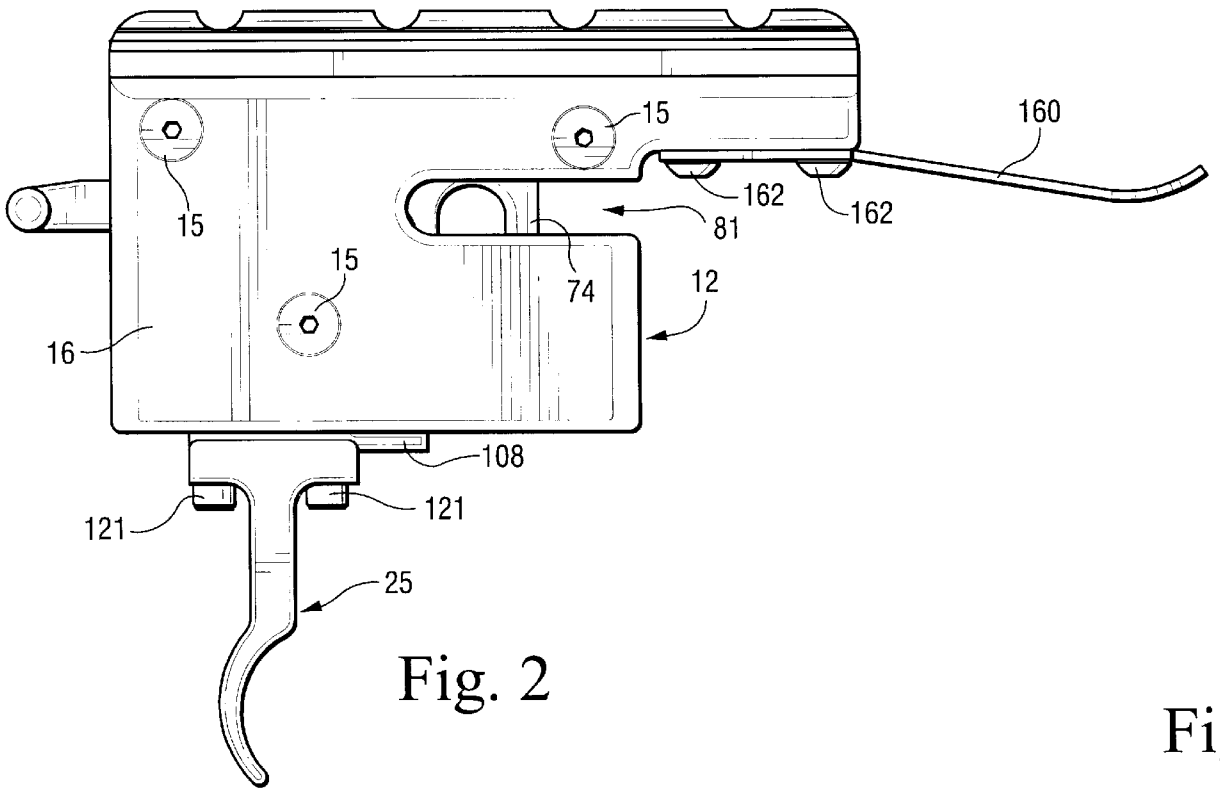
FIG. 2 is a side elevation of the assembled crossbow trigger mechanism shown in FIG. 1.
Figure 4:
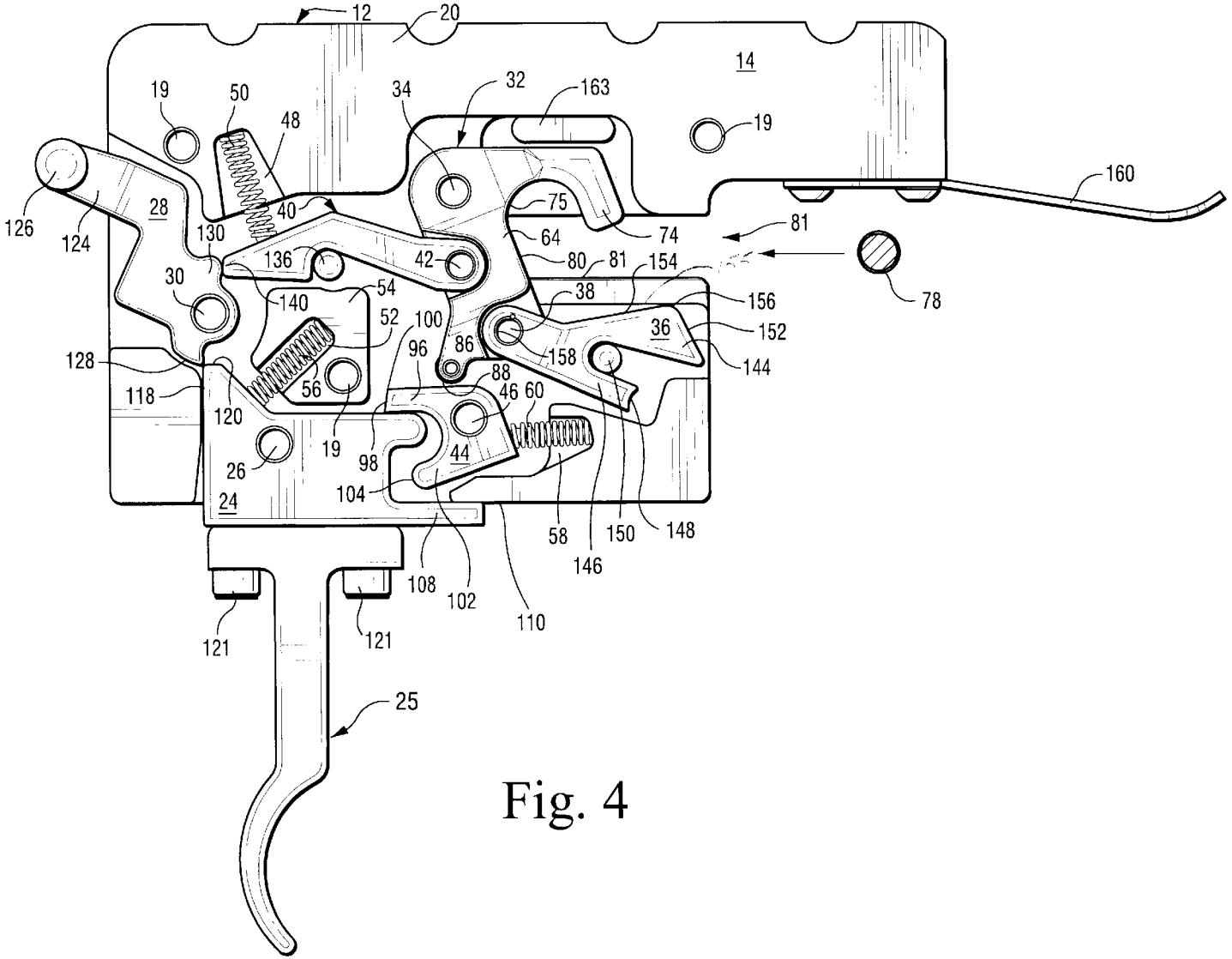
FIG. 4 is a side elevation of the crossbow trigger mechanism shown in FIG. 1, with the side cap or cover removed and with the jaw component shown in an open position, ready for cocking.

With reference initially to FIGS. 1–4, the crossbow trigger device 10 in accordance with the preferred embodiment of the invention includes a housing 12 formed as a cast or machined block or main body 14, in combination with a side cap or cover 16 secured to one side of the main body 14 by screws 15 or other suitable fasteners. The main body 14 is formed with an inner flat surface 18 and an outer flat surface 20. The main body 14 is also formed with a number of recessed areas in which are seated component parts of the trigger mechanism, with the inner flat surface 18 forming the floor or base of the recessed areas, and the outer flat surface 20 providing an outer engagement surface for the cap or cover 16. More specifically, and as best seen in FIGS. 1 and 4, a main recessed area 22 is designed to receive the trigger block 24, pivotably mounted in the housing via pin 26; an on/off safety lever 28 pivotably mounted in the housing via pin 30; a jaw component 32 (or simply "jaw") pivotably mounted in the housing via pin 34; a dry fire prevention lever 36 pivotably mounted to the jaw 32 within a jaw recess 60 via pin 38; a safety lever actuating link 40 that is pivotably mounted to the jaw 32 within a jaw recess 62 via pin 42; and a sear 44 pivotably mounted in the housing via pin 46. A recess 48 receives a coil spring 50 that bears on the safety lever actuating link 40. Another recess 52 formed in an "island" 54 of the housing receives a coil spring 56 that bears on the trigger block 24. A third recess 58 receives a coil spring 60 that bears on the sear 44.

Figure 5:
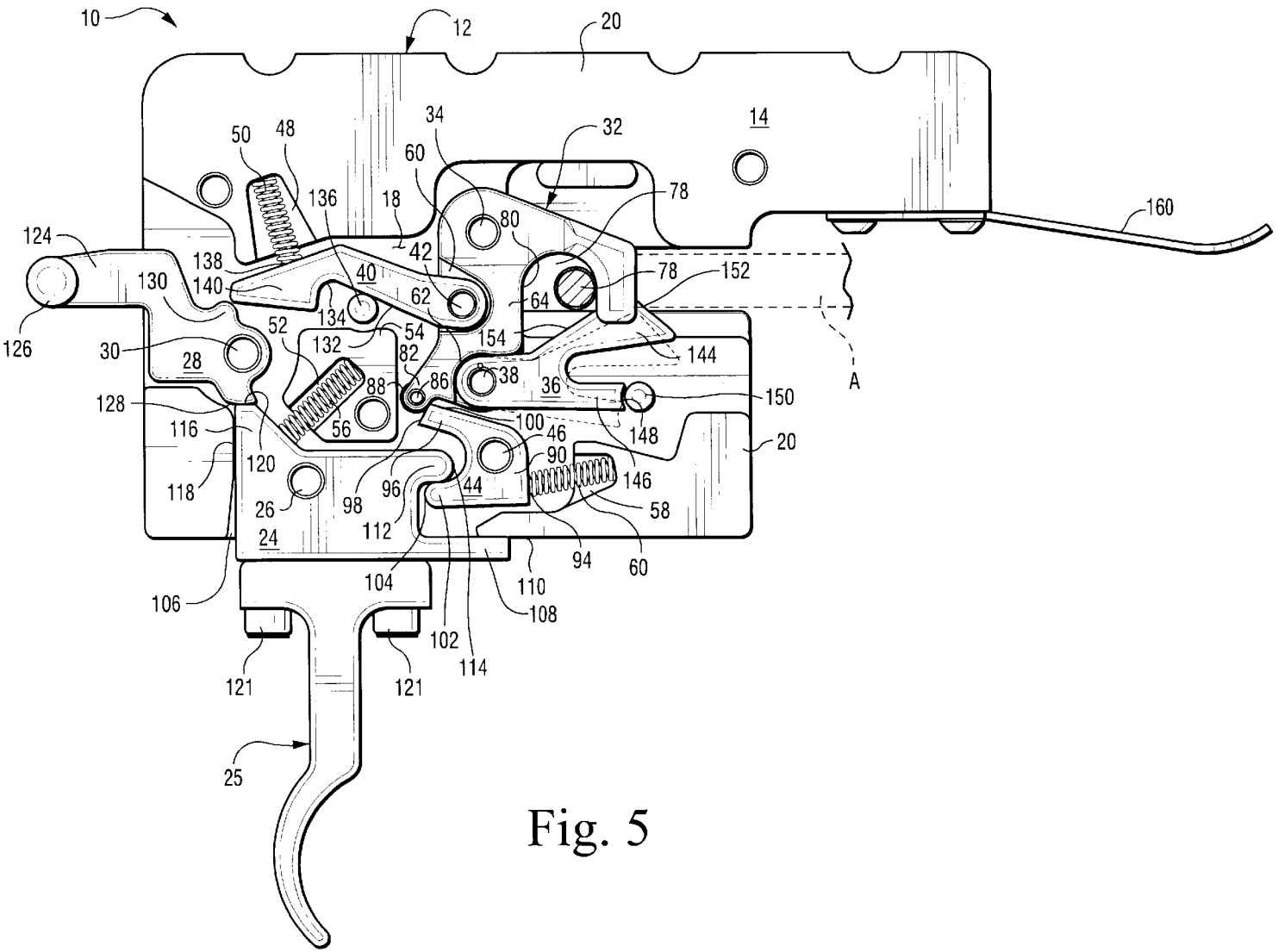
FIG. 5 is a side elevation similar to FIG. 4 but with the jaw component shown in a closed position and the bowstring cocked.

With reference also to FIGS. 7–10, the jaw 32 includes a center portion 64 formed with a hole 66 for the jaw pivot pin 34, the cut-away recesses 60 and 62, and holes 68, 70 for the pins 42, 38, respectively. A forward extension 72 includes a pair of downwardly extending bowstring retaining prongs 74, 76 that are used to restrain a bowstring 78. During cocking, the bowstring is adapted to engage the vertical face 80 of the jaw component. A rearward extension 82 is formed as a yoke and includes aligned holes 84 (one shown) for receiving a dowel pin 86 that serves an axle for a roller 88 mounted on the pin within the yoke (see FIG. 4). As explained further below, the jaw 32 is rotatable between a closed or bowstring retaining position shown in FIGS. 2, 3 and 5 and an open or bowstring releasing position shown in FIGS. 4 and 6.

Figure 11:
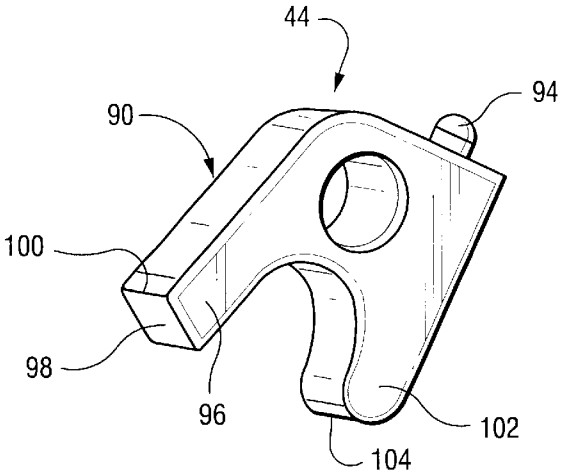
FIG. 11 is a perspective view of the sear element of the crossbow trigger mechanism taken from FIG. 1.
Figure 13:
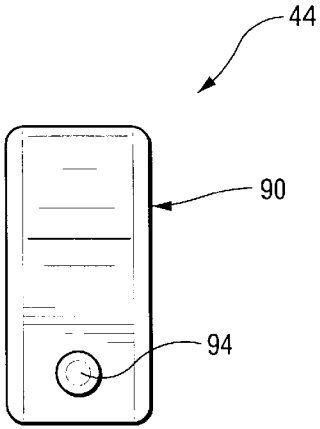
FIG. 13 is a front elevation of the sear element.
Figure 12:
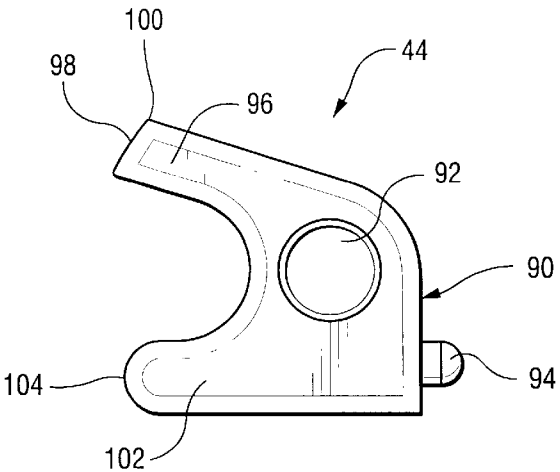
FIG. 12 is a side elevation of the sear element.

The sear element 44, best seen in FIGS. 11–13 includes a body 90 formed with a hole 92 for the pivot pin 46 and a forwardly projecting stub 94 that locates the coil spring 60. A first rearward lever portion 96 includes a back face 98 and an edge 100 that interacts with the roller 88 in the yoke 82 as explained further below. A second rearward lower portion 102 includes a curved edge 104 that interacts with the trigger block 24 as also explained further below.

Figure 16:
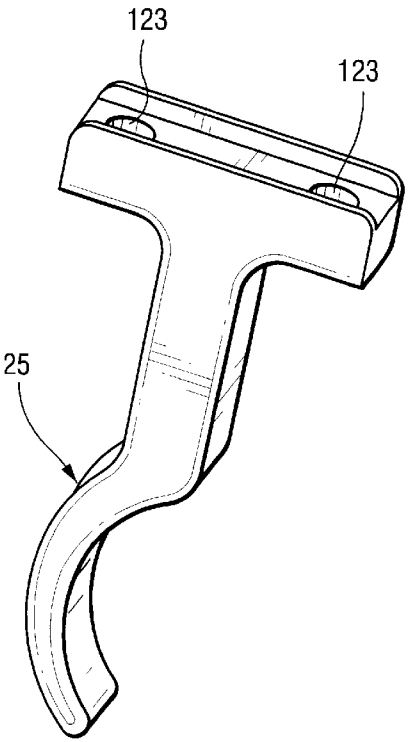
FIG. 16 is a perspective view of the trigger lever taken from FIG. 1.
Figure 15:
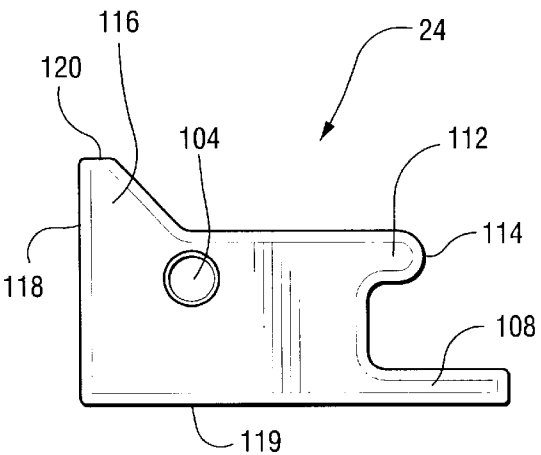
FIG. 15 is a side elevation of the trigger block shown in FIG. 14.
Figure 14:
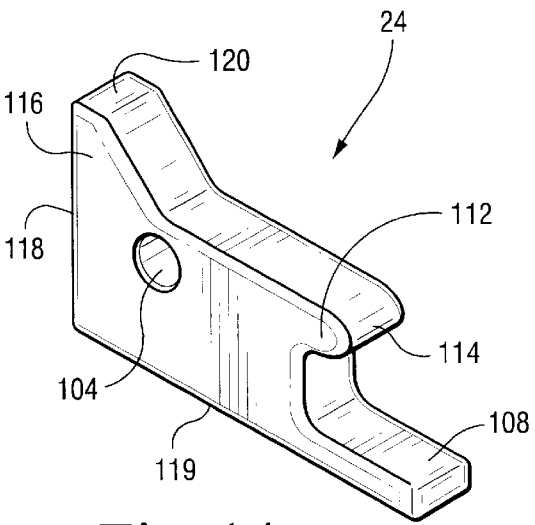
FIG. 14 is a perspective view of the trigger block taken from FIG. 1.

The trigger block 24, best seen in FIGS. 14–16 is formed with a hole 104 for receiving the pivot pin 26. The trigger block projects through an opening 106 in the housing, with a forward flange 108 engaging an external lower edge surface 110 of the housing. A shorter but parallel forward projection 112, vertically spaced from the flange 108 (so as to impart a C-shaped profile to the front of the block), includes a curved surface 114 that interacts with the curved edge 104 on the sear 44. The trigger block 24 also includes an upwardly extending projection 116 along a rearward edge 118, with an upper, flat surface 120 arranged to interact with the on/off safety lever 28. A trigger lever 25 (also see FIG. 16) is attached to the trigger block 24 along the lower surface 119 of the block and secured by fasteners 121 extending through holes 123 at the upper end of the trigger lever and into threaded bores (not shown) in surface 119. The trigger lever extends downwardly away from the housing, enabling the user to fire the arrow.

Figure 17:
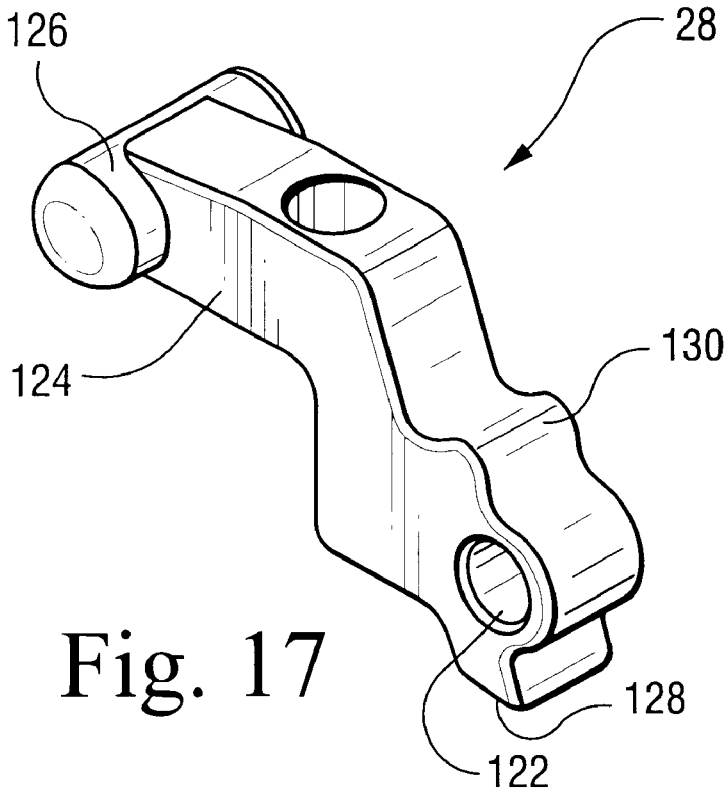
FIG. 17 is a perspective view of the safety lever taken from FIG. 1.
Figure 18:
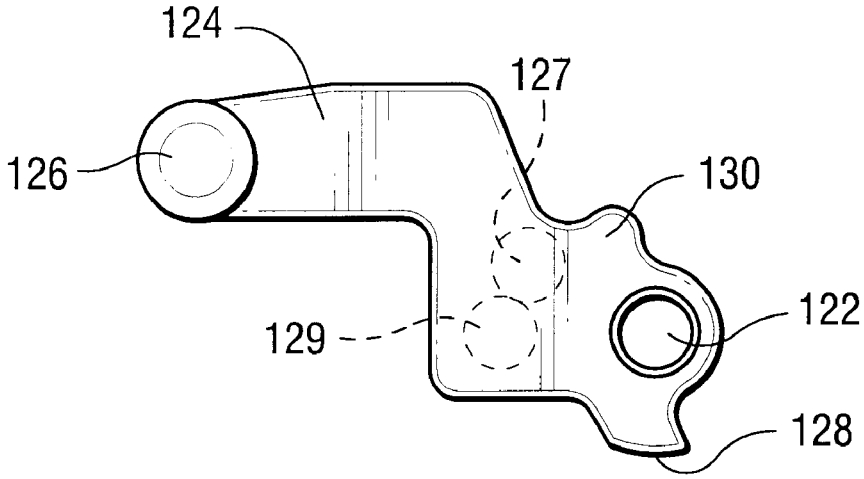
FIG. 18 is a side elevation of the safety lever shown in FIG. 17.

As best seen in FIGS. 17 and 18, the on/off safety lever 28 is formed with a hole 122 in its forward for receiving the pivot pin 30. The on/off safety lever 28 also includes a rearwardly projecting tab 124 incorporating a transverse pin 126 that protrudes from the rear of the housing and serves as a handle for the user to move the safety lever between "on" and "off" positions as described further herein. A curved trigger locking surface 128 extending below the hole 122 interacts with the surface 120 of the trigger block 24, while a rounded projection 130 extending above the hole 122 interacts with the safety lever actuating link 40 as described further herein. A ball 123 received in a cavity 126 in the main body 14 cooperates with detents 127, 129 (shown in phantom) formed on the back side of the safety lever to better define the "on" and "off" positions of the safety lever.

Figure 19:
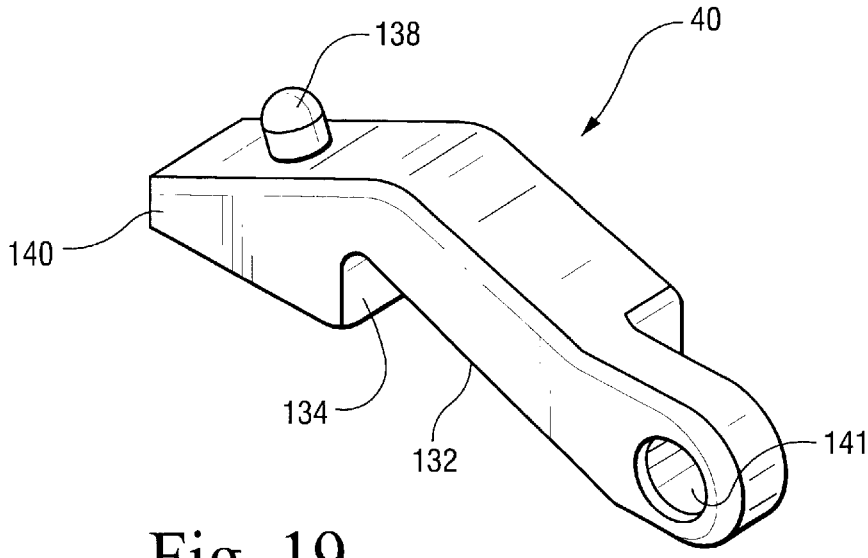
FIG. 19 is a perspective view of the safety lever actuating link taken from FIG. 1.
Figure 20:
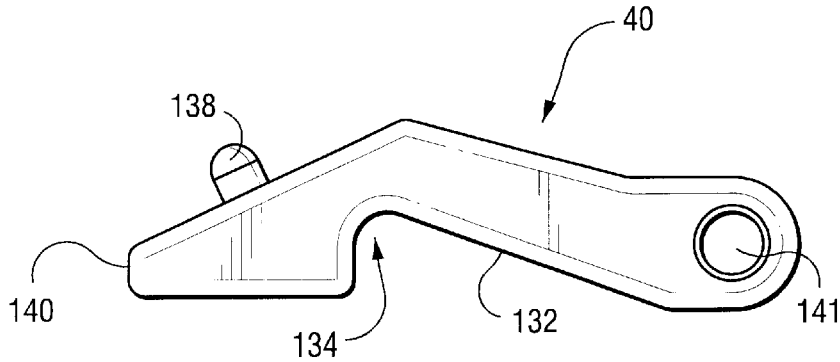
FIG. 20 is a side elevation of the safety lever actuating link shown in FIG. 19.

The safety lever actuating link 40 (best seen in FIGS. 19 and 20) extends rearwardly from the jaw 32 with a tapered surface 132 and notch 134 interacting with a transverse stop pin 136 fixed in the housing. A nub 138 locates the spring 50 and a rearward end portion 140 interacts with the rounded projection 130 on the safety lever to move the safety lever to the "on" position when the jaw 32 is moved from its open position to its closed position, i.e., during cocking. Note, however, that the safety lever 28 can be moved between the "on" and "off" positions by the user independent of the position of the jaw 32, via handle 126. A hole 141 at the forward end of the link enables mounting of the link 40 to the jaw 32 via pin 42.

Figure 22:
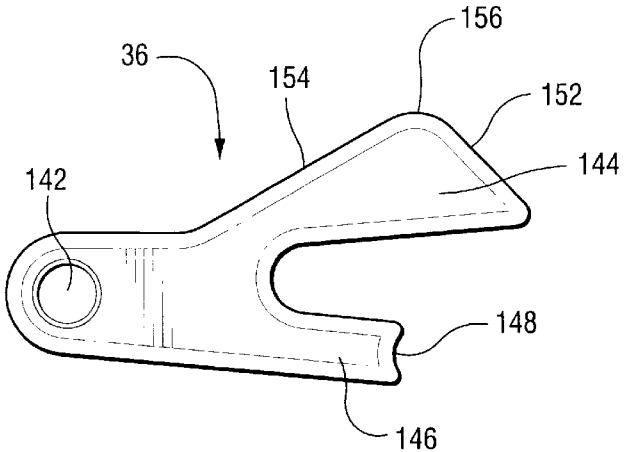
FIG. 22 is a side elevation of the dry fire prevention lever.
Figure 23:
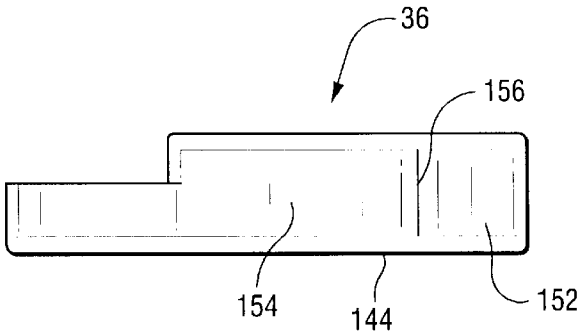
FIG. 23 is a top plan view of the dry fire prevention lever shown in FIG. 22.
Figure 21:
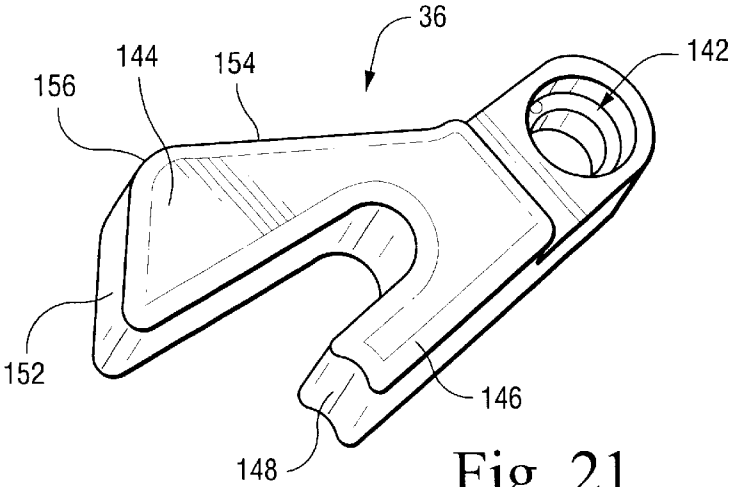
FIG. 21 is a perspective view of the dry fire prevention lever taken from FIG. 1.

With reference especially to FIGS. 21–23, the dry fire prevention lever 36 is provided with a hole 142 at its rearward end for receiving the pivot pin 38, and a C-shaped forward end with an upper, forwardly extending leg portion 144 that is designed to be engaged by an arrow as it is inserted into the crossbow for firing. A lower leg portion 146 includes a concave forward edge 148 adapted to engage a transverse pin 150 fixed in the housing. Note that the upper leg portion 144 includes oppositely tapered surfaces 152, 154 meeting at an apex 156, facilitating loading of the bowstring into the jaw component 32 in a rearward direction. A conventional torsion spring 158 is fitted onto the pivot pin 38 and serves to resiliently bias the lever 36 upwardly to the position shown in FIG. 1, with the forward edge 148 aligned with and closely adjacent the pin 150, also referred to herein as a "housing stop."

Figure 24:
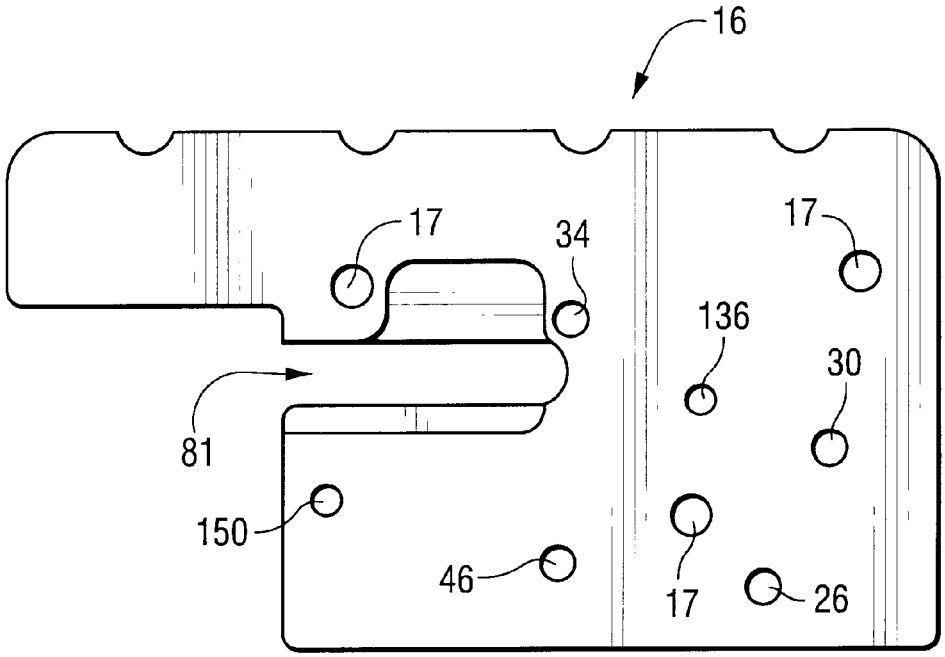
FIG. 24 is a side elevation of the crossbow trigger side cover or cup taken from FIG. 1, but reversed to show the interior side thereof.

FIG. 24 illustrates the interior side of the side cap or cover 16. Blind bores in the cover receive the various pivot pins that mount the internal components described above, as well as the stop pins 136 and 150. For convenience, the blind bores are labeled with reference numerals corresponding to the respective pivot and stop pins. The remaining apertures 17 in the side cap 16 receive the threaded fasteners 15 shown in FIGS. 1 and 2. These fasteners are threaded into corresponding threaded apertures 19 in the main body 14 of the housing 12.

The operation of the above described crossbow trigger will now be explained in detail. Turning first to FIG. 4, note that the jaw 32 is in the open position and the on/off safety lever 28 is in the "off" position. Specifically, the safety lever 28 is shown rotated upwardly in a clockwise direction about the pin 30 so that surface 128 is disengaged from the surface 120 of the trigger block 24. Trigger lever 25 is shown in a normal pre-firing position. The coil spring 56 normally maintains the trigger block 24 and associated trigger lever 25 in the ready-to-fire position, i.e., biased in a counterclockwise direction about pin 26.

As the bowstring 78 is pulled rearwardly in a cocking direction, through a slot 81 in the housing 12, the bowstring engages vertical face 80 of the jaw 32, causing the jaw 32 to move in a clockwise direction about the pivot pin 34. This pivoting action of the jaw 32 moves the roller 88 over the edge 100 and onto surface 98 of the sear 44, noting that spring 60 normally biases the sear in a clockwise direction about the pin 46. Clockwise movement of the jaw 32 also causes the safety actuating lever 40 to move rearwardly so that the rearward end portion 140 engages the rounded projection 130 on the on/off safety lever, thus causing the on/off safety lever to pivot in a counterclockwise direction about the pivot pin 30 to the "on" or locking position where the surface 128 overlies surface 120 of the trigger block, thereby preventing any pivoting movement of the trigger assembly and, hence, firing. Now the component parts are in the position shown in FIG. 5. Note that the dry fire prevention lever 36 is positioned such that the concave surface 148 on the lower leg 146 is aligned with and closely adjacent the fixed pin or housing stop 150 in the housing, thereby preventing any movement of the jaw component 32 to an open or bowstring releasing position.

When an arrow A (shown in phantom in FIG. 5) is loaded into the crossbow, the arrow will rest on surface 155 of the housing and will engage surfaces 152 and 156 of the dry fire prevention lever 36, causing the lever to pivot against the bias of torsion spring 158, in a clockwise direction about the pivot pin 38, thus causing the lower leg 146 and surface 148 to move downwardly away from the housing stop 150, so that the jaw 32 is free to move to the bowstring release position when the trigger is pulled. This position of lever 36 is shown in dotted lines in FIG. 5. As a result, one of the two safety mechanisms has now been deactivated. The user now manually rotates the on/off safety lever 124, via pin or handle 126, in a clockwise direction about the pivot pin 30 to disengage surface 128 from surface 120 of the trigger block 24 (to the position shown in FIG. 4), thus freeing up the trigger assembly and permitting the trigger lever 25 to be pulled for firing the arrow. Now, both safety mechanisms have been deactivated or moved to positions that permit firing of the arrow.

Figure 6:
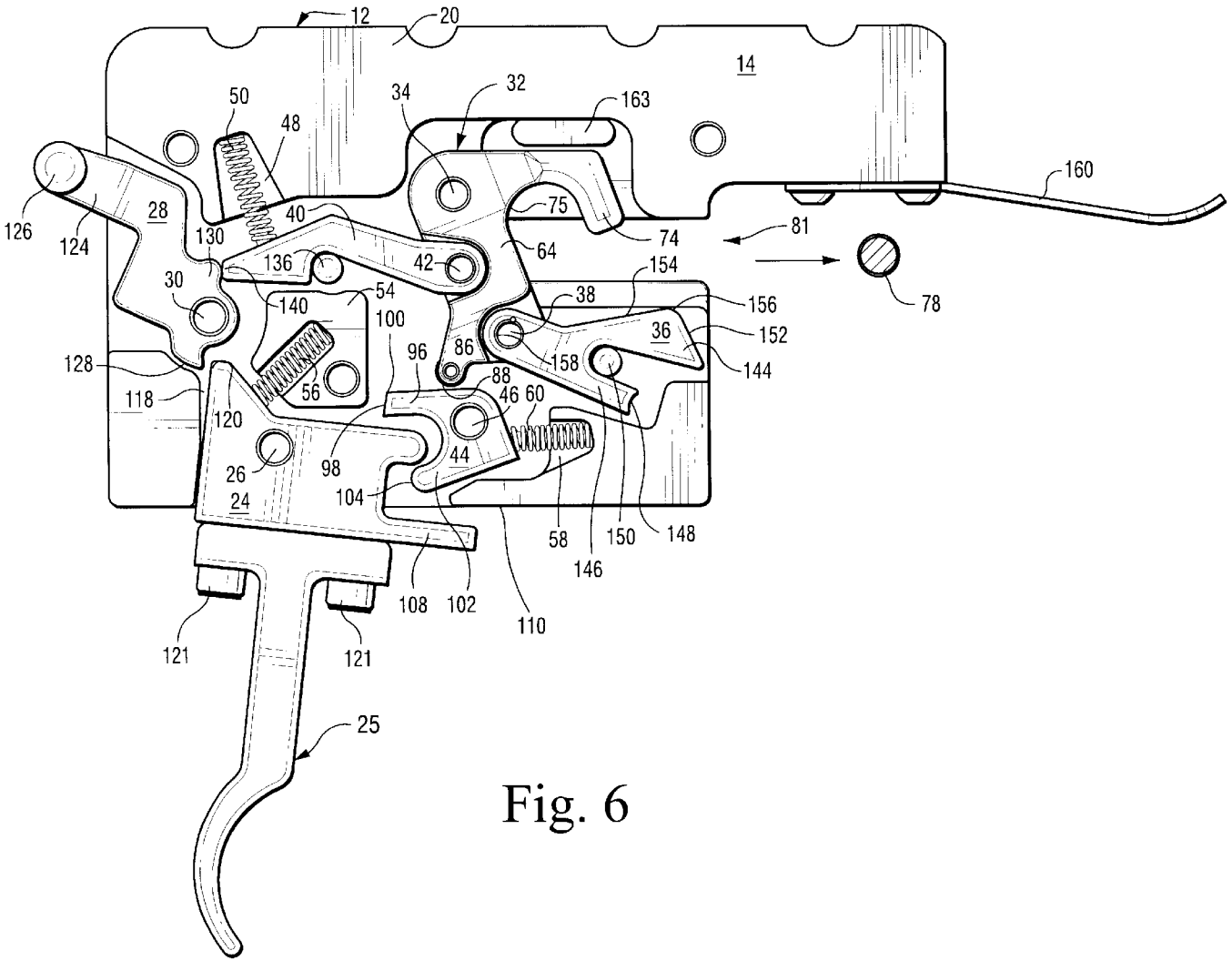
FIG. 6 is a side elevation similar to FIG. 5 but with the trigger pulled, the jaw component in an open position, and the bowstring released.
Figure 8:
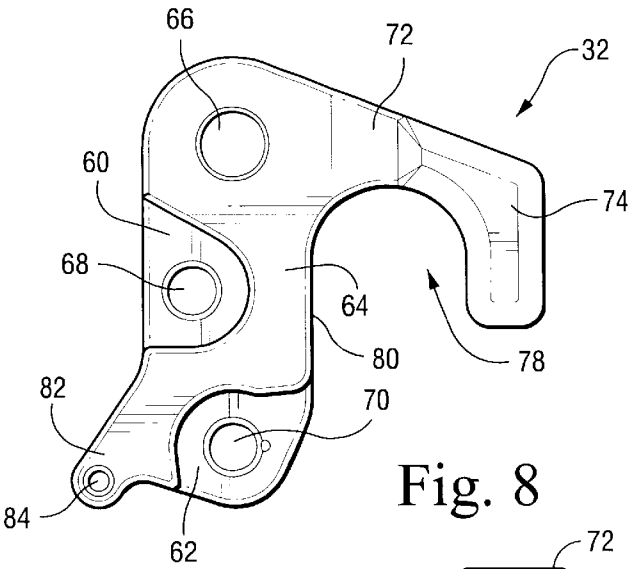
FIG. 8 is a side elevation of the jaw component shown in FIG. 7.
Figure 10:
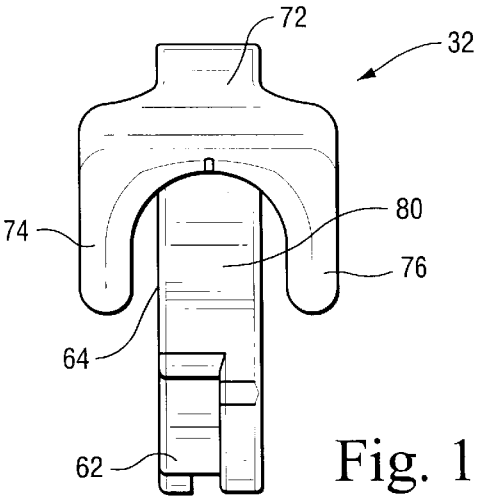
FIG. 10 is a front elevation of the jaw component shown in FIG. 8.
Figure 7:
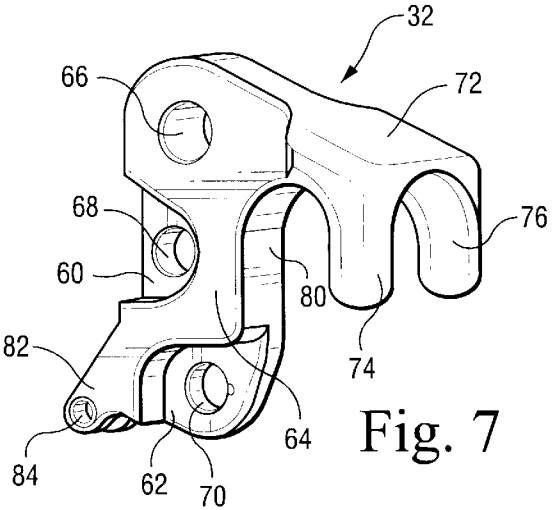
FIG. 7 is a perspective view of the jaw component taken from FIG. 1.
Figure 9:
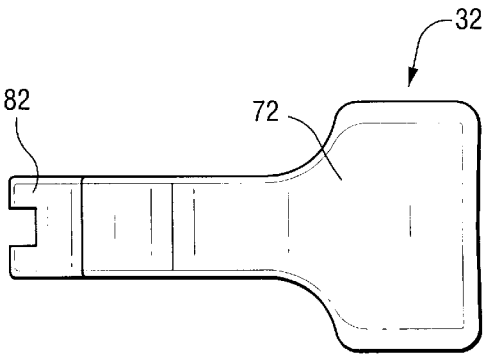
FIG. 9 is a top view of the jaw component shown in FIG. 8.

The user now may fire the arrow by pulling the trigger lever 25 to the left as shown in FIG. 6, drawing the trigger block 24 downward in a clockwise direction about the pivot pin 26. The forward projection 112 on the trigger block 24 engages the rearward lower portion 102 of the sear 44, causing the sear to move in a counterclockwise direction about the pivot pin 46. At the same time, the upper rearward lever portion 96 also moves in a counterclockwise direction, permitting the roller 88 of the jaw 32 to roll upwardly on the back face 98 and over the edge 100 of the sear, such that the tension in the bowstring 78 is free to act on the prongs 74, 76 to pivot the jaw 32 in a counterclockwise direction about the pivot pin 34, thus releasing the bowstring and firing the arrow.

It will be appreciated that the on/off safety lever 124 can be in the "on" or "off" position as the bowstring 78 is loaded and cocked but, as explained above, if the safety lever 124 is in the "off" position, it will be automatically moved to the "on" position during the cocking procedure. If the safety lever 28 is already in the "on" position during cocking, the remaining components of the trigger mechanism act in precisely the same way as described hereinabove.

In this first embodiment, a spring arm 160 is secured to the housing via screws or fasteners 162 and projects forwardly of the housing 12. The spring arm 160 serves to hold the arrow A in place when loaded into the crossbow.

An additional feature is the addition of a rubber bumper 163 that is preferably adhesively secured in the main body 14 of the housing above the jaw component 32, as best seen in FIGS. 1, 4 and 6. The bumper cushions the impact of the jaw component or the housing when the arrow is fired.

Figure 25:
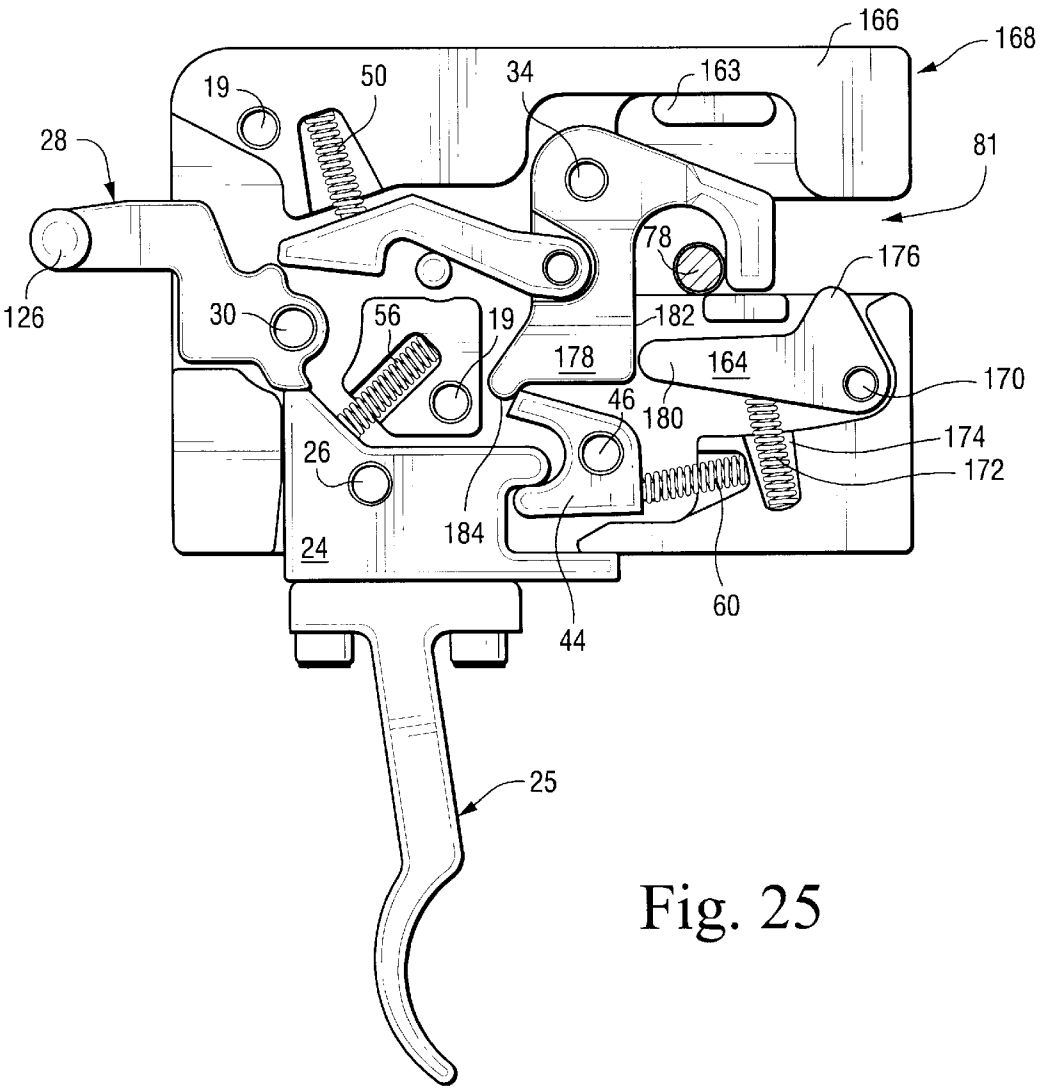
FIG. 25 is a side elevation of a crossbow trigger mechanism in accordance with a second embodiment of the invention, with the side cap removed, and with the jaw component shown in a closed position and the bowstring cocked.
Figure 26:
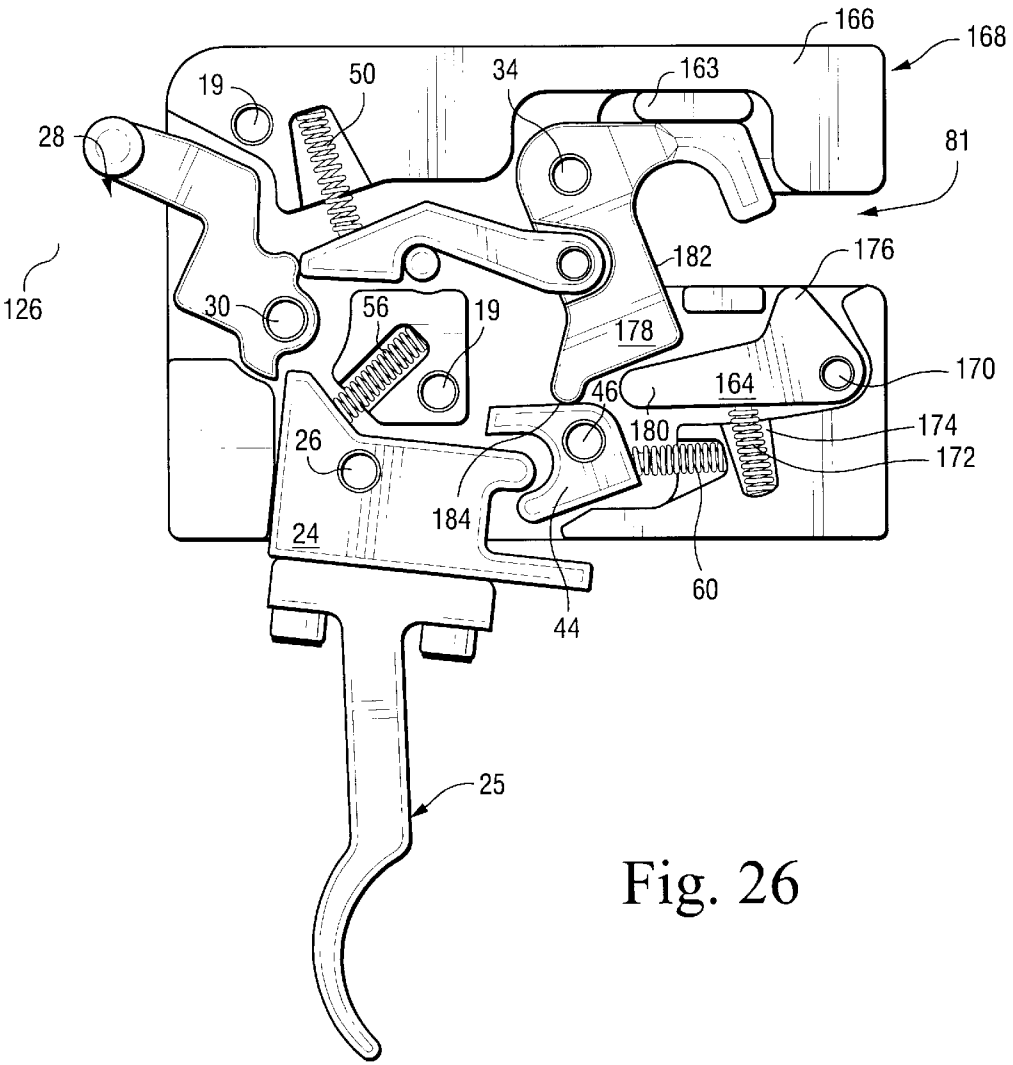
FIG. 26 is a side elevation similar to FIG. 25 but with the trigger pulled and with the jaw component shown in the open position.

In a second embodiment shown in FIGS. 25 and 26, the dry fire prevention lever is pivotably mounted directly to the housing and is adapted to engage the trigger block 24. For this second embodiment, the same reference numerals are used to designate components identical to those in the first described embodiment. The main body of the housing, jaw component and dry fire prevention lever are of different design. More specifically, and with reference to FIGS. 25 and 26, the dry fire prevention lever 164 is pivotably mounted to the main body 166 of the housing 168 via pin 170. A coil spring 172 received in a cavity 174 in the main body 166 biases the lever 160 in a counterclockwise direction about the pin 170 such that an upward projecting tab 176 protrudes into the arrow loading area forward of the prongs on the jaw 178. A rearwardly extending arm portion 180 of the lever engages a vertical face 182 of jaw 178 in this normal position, preventing counterclockwise movement of the jaw 178 and hence, preventing firing. When an arrow is placed in the crossbow, the dry fire prevention lever 164 will be forced to pivot in a counterclockwise direction about pin 164 such that arm portion 180 will move below the jaw 178 so that the jaw can pivot in a counterclockwise direction when the trigger is pulled, as shown in FIG. 26. The trigger mechanism otherwise works in generally the same manner as the first described embodiment, but note that the yoke and roller on jaw 32 has been removed in favor of a fixed camming surface 184 that interacts with the sear 44 in a generally similar manner as the roller.

Thus, the trigger mechanism of the present invention provides both an on/off manually operated safety lever as well as a dry fire prevention mechanism that 1) prevents accidental firing of an arrow loaded into the crossbow, and 2) prevents accidental dry firing when no arrow is loaded into the crossbow.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A crossbow trigger mechanism comprising:

a trigger housing;

a jaw component pivotably mounted in said trigger housing and adapted to move between a bowstring retaining position and a bowstring releasing position;

a trigger assembly pivotably mounted in said trigger housing and operatively engaged with said jaw;

a safety lever pivotably mounted in said trigger housing and movable manually into and out of engagement with said trigger assembly; and a dry fire prevention lever pivotably mounted on said jaw component and comprising a first surface portion adapted and arranged to engage a stop fixed to said trigger housing when no arrow is loaded in the crossbow and thus prevent movement of the jaw component to said bowstring releasing position, and a second surface portion adapted to be engaged by an arrow such that when an arrow is loaded into the crossbow, said first surface portion is moved away from said stop to thereby permit movement of said jaw component to said bowstring releasing position.

2. The crossbow trigger mechanism of claim 1 including a sear element pivotably mounted in said trigger housing and comprising a first leg portion engageable with said jaw component and a second leg portion engageable with said trigger assembly.

3. The crossbow trigger mechanism of claim 1 and further comprising a safety lever actuating link with one end pivotally mounted on said jaw component, and an opposite end engageable with said safety lever.

4. The crossbow trigger mechanism of claim 2 and further comprising a safety lever actuating link with one end pivotally mounted on said jaw component, and an opposite end engageable with said safety lever.

5. The crossbow trigger mechanism of claim 2 wherein said trigger assembly includes a trigger block and a trigger lever secured to said trigger block, said trigger block having a forward projection engageable with said second leg portion of said sear and a rearward projection engageable with said safety lever.

6. The crossbow trigger mechanism of claim 1 wherein said jaw component comprises a center portion, an upper forward extension including a pair of bowstring retaining prongs, and a lower rearward extension including a yoke having a roller mounted therein.

7. The crossbow trigger mechanism of claim 2 wherein said jaw component comprises a center portion, an upper forward extension including a pair of bowstring retaining prongs, and a lower rearward extension including a yoke having a roller mounted therein.

8. The crossbow trigger mechanism of claim 7 wherein said roller is engageable with said first leg portion of said sear.

9. The crossbow trigger mechanism of claim 4 wherein said jaw component comprises a center portion, an upper forward extension including a pair of cable retaining prongs, and a lower rearward extension including a yoke having a roller mounted therein, said roller arranged to engage said first leg portion of said sear.

10. The crossbow trigger mechanism of claim 9 wherein said center portion of said jaw component includes a first pivot pin mounting said jaw to said housing at an upper end of said center portion; a second pivot pin mounting said safety actuating lever to said jaw at an intermediate location of said center portion; and a third pivot pin mounting said dry fire prevention lever to said jaw at a lower end of said center portion.

11. A crossbow trigger mechanism comprising:

a trigger housing;

a jaw component pivotably mounted in said trigger housing and adapted to move between a bowstring retaining position and a bowstring releasing position;

a trigger assembly pivotably mounted in said trigger housing and operatively engaged with said jaw; and a dry fire prevention lever pivotably mounted on said jaw component comprising a first surface portion adapted and arranged to engage a stop fixed to said trigger housing when no arrow is loaded in the crossbow and thereby prevent movement of the jaw component to said bowstring releasing position, and a second surface portion adapted to be engaged by an arrow such that, when an arrow is loaded into the crossbow, said first surface portion moves away from said stop to thereby permit movement of said jaw component to said bowstring releasing position.

12. The crossbow trigger mechanism of claim 11 including a sear element pivotably mounted in said trigger housing and comprising a first leg portion engageable with said jaw component and a second leg portion engageable with said trigger assembly.

13. The crossbow trigger mechanism of claim 11 wherein said jaw component comprises a center portion, an upper forward extension including a pair of bowstring retaining prongs, and a lower rearward extension including a yoke having a roller mounted therein.

14. The crossbow trigger mechanism of claim 13 wherein said roller is engageable with said first leg portion of said sear.

15. The crossbow trigger mechanism of claim 11 wherein said stop comprises a pin.

16. The crossbow trigger mechanism of claim 11 wherein said dry fire prevention lever is normally resiliently biased to a position where said first surface portion is aligned with and adjacent said stop.

17. A crossbow trigger mechanism comprising:

a trigger housing adapted for mounting on a crossbow;

a jaw component pivotably mounted in said trigger housing and adapted to move between a bowstring retaining position and a bowstring releasing position;

a trigger assembly pivotably mounted in said trigger housing and operatively engaged with said jaw component;

a safety lever pivotably mounted in said trigger housing and movable manually into and out of engagement with said trigger assembly; and a safety lever actuating link with one end pivotally mounted on said jaw component, and an opposite end engageable with said safety lever.

18. The crossbow trigger mechanism of claim 17 including a sear element pivotably mounted in said trigger housing and comprising a first leg portion engageable with said jaw component and a second leg portion engageable with said trigger assembly.

19. The crossbow trigger mechanism of claim 18 wherein said trigger assembly includes a trigger block and a trigger lever secured to said trigger block, said trigger block having a forward projection engageable with said second leg portion of said sear and a rearward projection engageable with said safety lever.

20. The crossbow trigger mechanism of claim 17 wherein said jaw component comprises a center portion, an upper forward extension including a pair of bowstring retaining prongs, and a lower rearward extension adapted to engage said sear.

21. The crossbow trigger mechanism of claim 20 wherein said lower rearward extension includes a roller engageable with said first leg portion of said sear.

22. The crossbow trigger mechanism of claim 20 wherein said lower rearward extension includes an integral, curved camming surface engageable with said first leg portion of said sear.

23. The crossbow trigger mechanism of claim 17 and further comprising a dry fire prevention lever pivotably mounted in said housing and having a first surface portion adapted to engage said jaw component when no arrow is loaded in the crossbow and thereby prevent movement of the jaw component to said bowstring releasing position, and a second surface portion adapted to be engaged by an arrow such that, when an arrow is loaded into the crossbow, said dry fire prevention lever moves out of engagement with said jaw component to thereby permit movement of said dry fire prevention lever to said bowstring releasing position.

24. The crossbow trigger mechanism of claim 23 and further comprising a coil spring received in a slot in said housing and biasing said dry fire prevention lever to a position where said first surface portion engages said jaw component.

25. The crossbow trigger mechanism of claim 17 and further comprising a bumper between the housing and the jaw component for cushioning impact between the jaw component and the housing upon firing of an arrow.

26. The crossbow trigger mechanism of claim 17 and further comprising a spring arm projecting forwardly of the housing for holding an arrow in place on the crossbow.

27. The crossbow trigger mechanism of claim 17 and further comprising ball and detent means for defining on and off positions of the safety lever.

* * * * *